US011808276B2

(12) United States Patent
Nagy et al.

(10) Patent No.: US 11,808,276 B2
(45) Date of Patent: Nov. 7, 2023

(54) SYSTEMS, METHODS, AND APPARATUS FOR BLOWING OUT BIRTHDAY CANDLES

(71) Applicants: Codie David Nagy, Langley (CA); Marek Smusz, Burnaby (CA)

(72) Inventors: Codie David Nagy, Langley (CA); Marek Smusz, Burnaby (CA)

( * ) Notice: Subject to any disclaimer, the term of this patent is extended or adjusted under 35 U.S.C. 154(b) by 140 days.

(21) Appl. No.: 17/243,568

(22) Filed: Apr. 28, 2021

(65) Prior Publication Data

US 2022/0349412 A1 Nov. 3, 2022

(51) Int. Cl.

| | |
|---|---|
| ***F04D 25/08*** | (2006.01) |
| ***F04D 19/00*** | (2006.01) |
| ***F04D 29/54*** | (2006.01) |
| ***F04D 29/52*** | (2006.01) |
| ***F04D 29/32*** | (2006.01) |

(52) U.S. Cl.

CPC ..... *F04D 25/086* (2013.01); *F04D 19/002* (2013.01); *F04D 29/325* (2013.01); *F04D 29/522* (2013.01); *F04D 29/541* (2013.01)

(58) Field of Classification Search

CPC .... F04D 25/086; F04D 19/002; F04D 29/325; F04D 29/522; F04D 29/541

See application file for complete search history.

(56) References Cited

U.S. PATENT DOCUMENTS 4,107,871 A * 8/1978 Hornsby, Jr. ..... A63H 27/14 446/41

5,545,068 A * 8/1996 Asbaghi ..... A63H 27/14 446/260

* cited by examiner

*Primary Examiner* — Jacob M Amick
*Assistant Examiner* — Ruben Picon-Feliciano

(57) ABSTRACT

Methods and apparatus for blowing out birthday candles are presented. The apparatus may include a rotor comprising at least two blades and attachable to a wind-up launcher for imparting a rotational impulse to the rotor. Each blade of the rotor may include a blade scoop extending from a central hub of the rotor to an outer safety ring positioned around an outer circumference of the rotor and coupled to each of the central hub and the outer safety ring. The blade scoop may have a convex shaped leading edge. The blade may also include a blade overhang for pushing air from the blade scoop out from the rotor. The blade overhang may have a trailing edge positioned below the central hub, with a portion of the blade forming the trailing edge having a tangent that is angled between 30 and 60 degrees below a plane of the outer safety ring.

12 Claims, 4 Drawing Sheets

SYSTEMS, METHODS, AND APPARATUS FOR BLOWING OUT BIRTHDAY CANDLES

TECHNICAL FIELD

The present disclosure relates to air blowers, and in particular, hand powered air blowers for blowing out candles.

BACKGROUND

Placing candles on a birthday cake and blowing them out is a long and cherished tradition for many people. Unfortunately, blowing out candles by exhaling on the candles while the candles are on a cake may be problematic. Bodily fluids, possibly containing infectious agents, may land on the cake. People who eat the cake or are in the vicinity when the candles are blown out, may be exposed to said infectious agents. Other people may not want to eat cake that someone has blown the candles out on by exhaling all over it due to safety concerns.

Other ways of extinguishing the candles may be used. For example, products exist that may be used to physically snuff out individual candles. Mechanical air blowers are also available for use. These may include air blowers that use rotary fan blades and air blowers that use pumps to blow air.

There exists a continuing desire to advance and improve technology related to air blowers for blowing out candles.

SUMMARY

According to one aspect, there is provided an apparatus for blowing out candles. The apparatus includes a body for holding the apparatus and housing parts of the apparatus. The apparatus may also include a rotor with at least two blades for spinning and generating air flow for blowing out the candles. The rotor may have a first mating portion for mating with a corresponding second mating piece at a first end of the body for holding the rotor against the first end. The apparatus may also have a charging rod coupled to the body for transferring a rotational impulse to the rotor for rotating the rotor in a first direction. The charging rod may also have a first rod end coupleable to the rotor.

The apparatus may also include a rotation limiter coupled to at least one of the first mating piece and the second mating piece for limiting rotation of the rotor to a second direction while the rotor is attached to the first end. The apparatus may also include a release body coupled to the body and coupleable to the rotor for pushing the rotor away from the rotation limiter and allowing the rotor to freely rotate in the first direction due to the rotational impulse from the charging axle. In addition, the apparatus may include an activator for activating the release body and the activator may be coupled to the release.

The apparatus may also include a guide coupled to the first end of the body for constraining non-rotational movement of the rotor to a path along the guide where the guide has a restraining end for stopping the rotor from decoupling from the guide. Transfer of the rotational impulse from the charging axle to the rotor upon activation of the release body may cause the rotor to decouple from the charging rod and to spin freely along the guide, thereby generating airflow for blowing out the candles.

The apparatus may also include a spring coupled to the charging rod for storing energy when charged by the charging rod and releasing the stored energy to the rotor through the charging rod upon activation of the release.

The charging rod may include the release. The guide may be coupled to the charging rod. The guide may extend out along a spin axis of the rotor upon the charging rod transferring a rotational impulse to the rotor.

The rotor may also include a central hub comprising the first mating portion and an opening centred around a spin axis of the rotor for receiving the charging rod. Additionally, the rotor may include an outer safety ring positioned along an outer circumference of the rotor and coupled to a distal edge of each blade for providing rigidity to the rotor and for partially shielding the blades from external objects.

Each blade of the rotor may comprise a blade scoop extending from a central hub of the rotor to an outer safety ring positioned around an outer circumference of the rotor. The blade scoop may have a convex shaped leading edge for gathering air for the blade scoop to push along the blade. Each blade may also have a blade overhang for pushing air from the blade scoop out from the rotor. The blade overhang may have a trailing edge positioned below the central hub, with a portion of the blade forming the trailing edge having a tangent that may be angled at least about 30 degrees below a plane that the outer circumference lies in. The blade scoop and blade overhang may be sized and positioned to create a directed airstream for blowing out the birthday candles. In some embodiments, the tangent may be angled at least about 45 degrees below the plane that the outer circumference lies in. In certain embodiments, the tangent may be angled at least about 60 degrees below the plane that the outer circumference lies in.

The convex shape of the leading edge may be formed by the leading edge curving up away from a bottom of the central hub and then down to the outer safety ring.

A height of the blade may be equal to at least ¼ of a length of the blade, wherein the height is the shortest distance between a bottom plane, the bottom plane parallel to the plane of the outer circumference and touching a part of the trailing edge furthest below the central hub, and a point of the blade furthest from the bottom plane along an axis perpendicular to the bottom plane, and the length of the blade is the chord length between an intersection of the outer safety ring and a projection of the leading edge onto a plane of the outer safety ring and an intersection between the outer safety ring and a projection of the trailing edge onto the plane of the outer safety ring. In some embodiments, the height of the blade may be equal to at least ⅓ of the length of the blade.

According to another aspect, there is provided a rotor for blowing out birthday candles, the rotor comprising at least two blades and attachable to a wind-up launcher for imparting a rotational impulse to the rotor. Each blade of the rotor may include a blade scoop extending from a central hub of the rotor to an outer safety ring positioned around an outer circumference of the rotor and coupled to each of the central hub and the outer safety ring. The blade scoop may have a convex shaped leading edge for gathering air for the blade scoop to push along the blade. Each blade may also include a blade overhang for pushing air from the blade scoop out from the rotor. The blade overhang may have a trailing edge positioned below the central hub, with a portion of the blade forming the trailing edge having a tangent that is angled at least about 30 degrees below a plane that the outer circumference lies in.

According to another aspect, there is provided a method for blowing out candles. The method may include attaching a rotor for blowing air to a housing by pushing the rotor onto a mating piece of the housing such that the rotor is coupled to both the housing and a charging rod. The method may also include rotating the rotor in a second direction to rotate the charging rod and wind up a spring coupled to the charging rod. The method may also include limiting rotation of the rotor to the second direction to keep the spring wound up by engaging rotation limiters between the rotor and the housing. The method may further include generating air flow by imparting a rotational impulse to the rotor from the spring through the charging rod by pushing the rotor away from the rotation limiters and releasing the rotor from the charging rod to allow the rotor to spin freely. The method may also include guiding the non-rotational movement of the rotor by having the rotor spin freely along a guide extending from the charging rod and keeping the rotor from falling away from the guide by having the rotor fall against a constraint at an end of the guide.

The method may also include generating air flow by pushing air along each of two or more blades of the rotor, whereby air flow is created by capturing air under a convex shaped leading edge of the blade as the rotor spins. The method may also include directing airflow to blow out the birthday candles by directing airflow away from a plane the rotor spins in by pushing air flowing along the blade using a trailing edge that is formed by an overhanging portion of the blade that is angled at least 30 degrees below the plane the rotor spins in.

BRIEF DESCRIPTION OF THE DRAWINGS

In the accompanying drawings, which illustrate one or more example embodiments.

DETAILED DESCRIPTION

Figure 1:
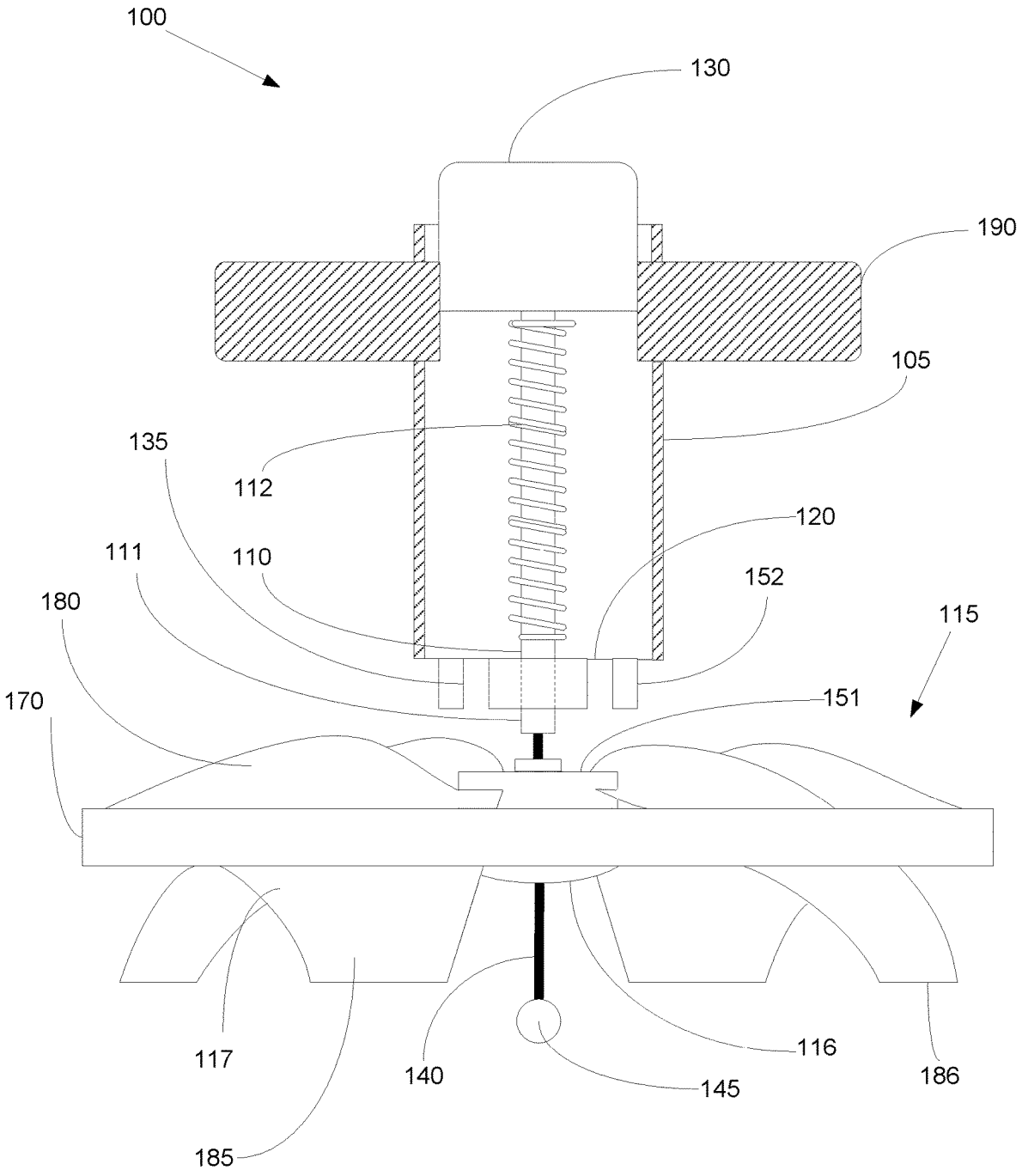
FIG. 1 is a partial sectional view of an air blower, according to one embodiment.

Directional terms such as "top", "bottom", "upper", "lower", "left", "right", and "vertical" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", "coupling", and "couplable" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections. The term "couplable", as used in the present disclosure, means that a first device is capable of being coupled to the second device. A first device that is communicatively couplable to a second device has the ability to communicatively couple with the second device but may not always be communicatively coupled.

As already discussed, blowing out birthday candles on a birthday cake is a widely practiced tradition. Children in particular enjoy this tradition. However, concerns about infectious agents being spread by exhaling onto a cake have come to the forefront due to the ongoing global pandemic.

Various methods and apparatus have been made available to continue the tradition of blowing out birthday candles without exhaling onto the candles. For example, candles may be snuffed out. However, apparatus for snuffing out candles snuffs out individual candles and not multiple candles at once. Additionally, the tradition of blowing out candles is not imitated well by using a snuffing apparatus. Imitating a large breath of air blown out may be preferable to people, particularly children, looking for an alternative to exhaling breath to blow out candles.

Air blowers, such as fans, are also available. Electrically powered fans, in addition to needing a power source or batteries, may not provide a sudden blast of air to blow out candles. The fan may build up to a speed capable of generating sufficient air flow for blowing out several candles.

Pump based air blowers are also available for blowing out birthday candles. These air blowers may be operated by drawing back a handle attached to a piston for drawing in air to a chamber and then rapidly pushing the handle in to force the air in the chamber through a nozzle. The nozzle may need to be narrowed sufficiently so as to generate air flow with enough velocity to blow out a candle. Narrowing the nozzle to narrow the air stream to increase the velocity of the air flow may narrow the air stream to an extent that the user may need to swing the apparatus around to direct it at individual candles or small groups of candles. Additionally, pump based air blowers for blowing out candles may be relatively large. The chamber holds sufficient air for blowing out numerous candles, which may be more than a litre of air.

The present disclosure provides a manually powered compact air blower for blowing out candles. The air blower is a rotor based air blower. The air blower may store up energy and then release the energy as an impulse to spin the rotor to create a blast of air. For example, a spring may be used for storing energy. The spring may be wound up and then released, providing a rotational impulse to spin the rotor.

Blades of the rotor may be shaped to take advantage of the rotational speeds associated with a manually powered rotor, which may be, in some embodiments, lower than certain electric fans, and of the short amount of time the rotor may spin. Air flow may be increased by increasing the surface area of the blades and having a sharply angled portion of the blade for pushing air away from the rotor. For high-speed fans and rotors meant to spin for more than a few seconds, blades with surfaces that bend at about 30 degrees to 60 degrees may be impractical due to high air resistance. However, using blades with a sharp angle for use in a spring powered air blower may be advantageous by increasing the amount of air scooped and directed away from the rotor in the short period that the rotor spins. A burst of air for blowing out multiple candles may be generated by winding up and releasing a rotor with high air resistance.

Using a wound spring to provide a rotational impulse may also be advantageous in releasing the spring's stored energy over a short period of time, which may, in some embodiments, bring the rotor to top speed in a short amount of time, thereby providing a burst of air from the rotor.

The apparatus of the present disclosure may also be compact. A compact design may be advantageous for decreasing costs in materials used, packaging costs, storage costs and shipping costs. Additionally, a compact air blower may be advantageous for users as a compact air blower may be easier to handle, particularly for children, and may be easier to store than large air blowers.

An additional advantage of the apparatus of the present disclosure is that the rotor may detach from the rod that imparts a rotational spin to the rotor from the spring. The rotor may thus spin freely and not expend energy by spinning the rod and attached spring, thereby increasing the amount of time the rotor may spin. A guide with a widened end may be used for guiding any non-rotational motion of the rotor and keeping the rotor from flying away from the apparatus. The guide may allow the rotor to move laterally along the spin axis, thereby keeping the direction of airflow from the rotor directed towards a chosen target while allowing free rotation around the spin axis.

A wind-up rotor based air blower, in which the rotor may partially release from the body to spin freely, as provided in the present disclosure, may also be advantageous because such an air blower may provide a level of fun for children that electric powered or pump based blowers may not.

Figure 2A:
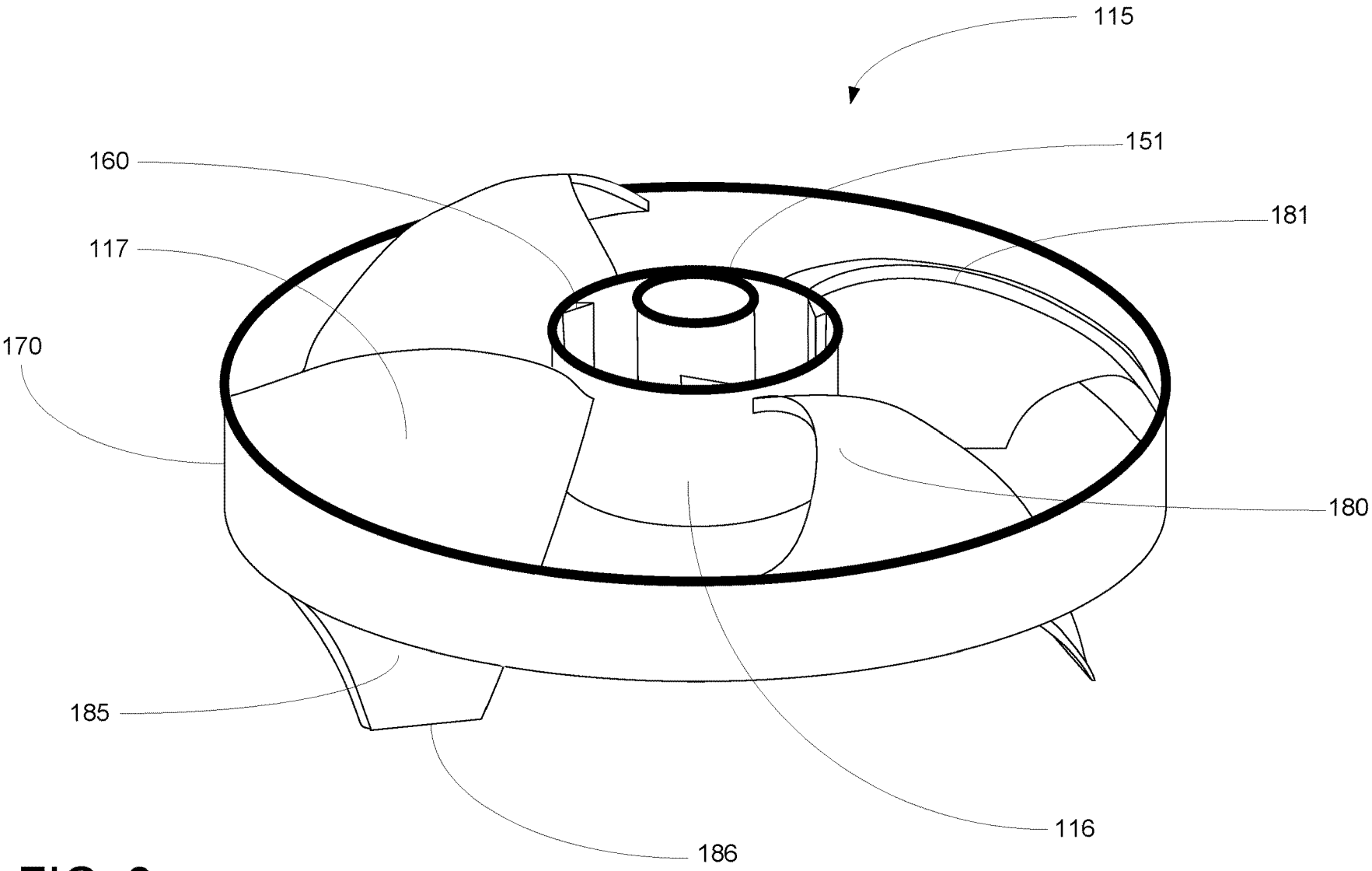
FIG. 2*a* is a perspective view of a rotor, according to one embodiment.
Figure 2B:
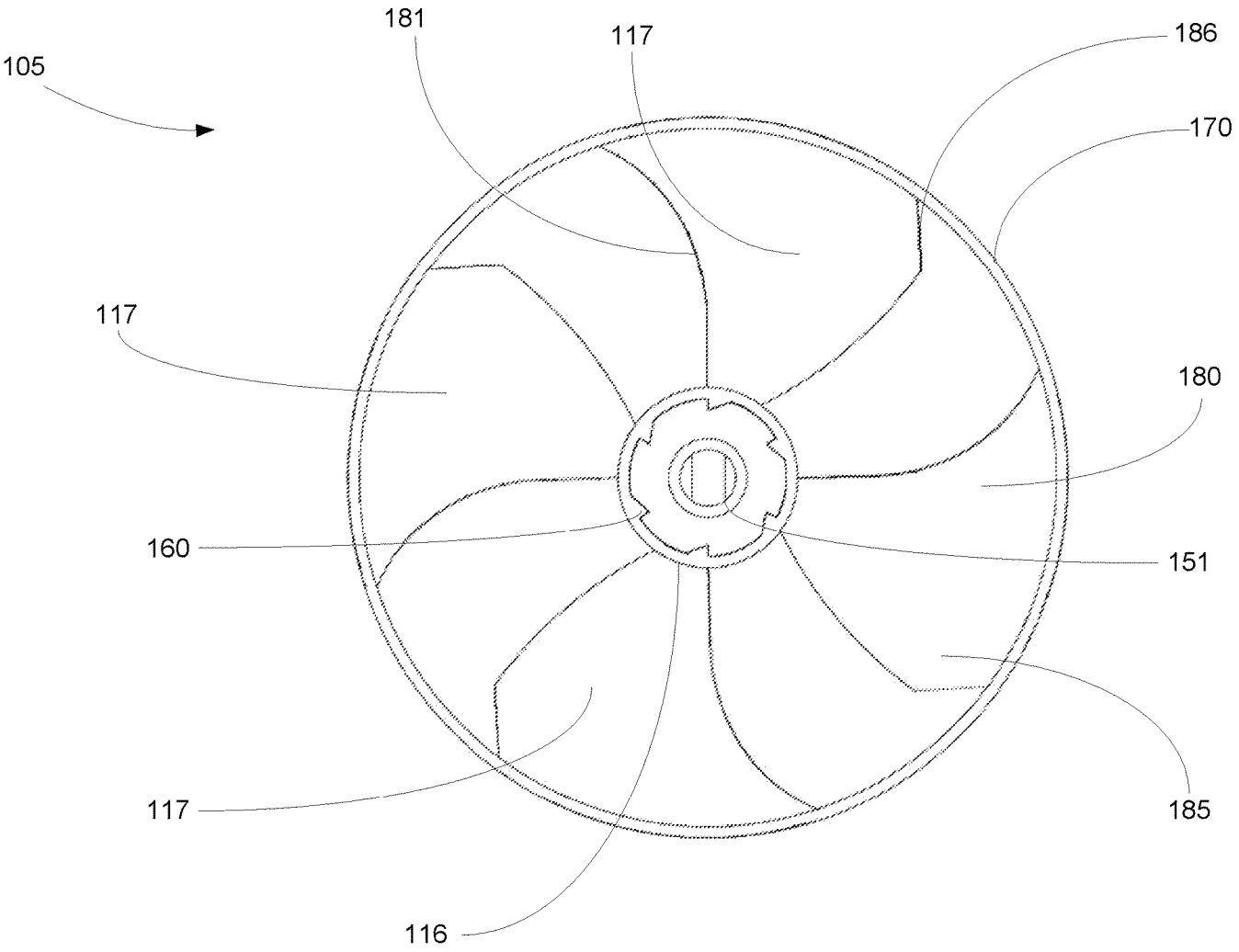
FIG. 2*b* is a top view of a rotor, according to one embodiment.

Referring to FIG. 1, FIG. 2*a* and FIG. 2*b*, embodiments of an apparatus 100 for blowing out candles are shown. In some embodiments, the apparatus may include a body 105 for housing some parts of the apparatus 100. The body 105 may also be shaped and sized for a user to hold while making use of the apparatus 100. The body 105, in some embodiments, may house a charging rod 110 for charging a rotor 115. The charging rod 110 may be used for charging an energy storage device. In some embodiments the energy storage device may comprise a spring 112. The spring 112 may also be housed within the body 105, with one end attached to the body 105 and some portion coupled to the charging rod 110 for energy transfer to and from the charging rod 110.

The rotor 115 may be coupleable to a first end 120 of the body 105 and to a coupling end 111 of the charging rod 110. The charging rod 110 may be rotatable by rotating the rotor 115, to which the charging rod 110 is coupled. Rotating the charging rod 110 may wind up the spring 112. The body 105 and the rotor 115 may have corresponding rotation limiters 135 for limiting rotation of the rotor 115 relative to the body 105 to one direction, allowing the rotor 115 to be used for winding the spring 112 through the charging rod 110.

The apparatus 100 may also comprise an activator 130 coupled to the body 105. The activator 130 may also be coupled to a release bar. In some embodiments, the charging rod 110 may act as the release bar. Activating the activator 130 may cause the charging rod 110 to push the rotor 115 away from the body 105 such that the rotor 115 disengages from the rotation limiter 135 of the body 105. Disengagement of the rotor 115 from the rotation limiter 135 lets the spring 112 unwind, causing the charging rod 115 to spin and transfer a rotational impulse to the rotor 115.

Upon receiving the rotational impulse from the charging rod 110, the rotor 115 may disengage from the charging rod 110 and spin freely. A guide 140 may be coupled to the first end 120 of the body 105. The guide 140 may also be coupled to the rotor 115, with the guide 140 passing through a spin axis of the rotor 115 such that the rotor 115, after disengaging from the charging rod 110, may spin freely while moving along the guide 140. The guide 140 may comprise a widened end 145 for keeping the rotor 115 from coming free of the apparatus 100.

Referring again to FIG. 1, in some embodiments, the body 105 may comprise a housing and a handle. The body 105 may be of any suitable shape and size for use as a housing and a handle. For example, for use as a housing, the body 105 may, in some embodiments, comprise a cylindrical shell. In certain embodiments, a portion of the body 105 may comprise a shape having a square or rectangular cross section. The body 105 may be sized to be sufficiently large to house the parts of the apparatus 100. For example, in some embodiments, a cross-sectional width of the body 105 may be about 0.75" to 2". In certain embodiments, the housing portion of the body 105 may also function as a handle with the body 105 being sized and shaped to be held. In some embodiments, the outer surface of the body 105 may be textured for gripping. Any suitable type of texturing may be used.

In certain embodiments, the body 105 may include a flanged portion 190 as a handle, as shown in FIG. 1. The flanged portion 190 may be, for example, at or adjacent to a top end of the body 105, with the top end being an end distal to the first end 120. The flanged portion 190 may be of any suitable size and shape. For example, the flanged portion 190 may be about 2" to 3" inches in length and about 0.5" to 1" wide.

The body 105 may be of any suitable length. For example, in some embodiments, the body may have a length of about 1.5" to 3". In certain embodiments, the length of the body may be about 2".

The body 105 may be formed of any suitable material or combination of materials. For example, the body 105 may be formed, without limitation, of plastic, metal, wood, rubber, ceramic or composite materials.

Referring again to FIG. 1, in some embodiments, the charging rod 110 may be coupled to the body for transferring a rotational impulse to the rotor for rotating the rotor in a first direction. In certain embodiments, the charging rod 110 may transfer energy from a source or a storage device to the rotor 115. For example, in certain embodiments, the charging rod 110 may transfer energy stored in the spring 112 to the rotor 115.

In some embodiments, the charging rod 110 may be used to charge up or wind the spring 112. For example, in certain embodiments, the apparatus 100 may comprise a spring 112 coupled to the charging rod 110 for storing energy when charged by the charging rod 110 and releasing the stored energy to the rotor 115 through the charging rod 110 upon activation of a release bar. The spring 112 may be charged, or wound up, by rotating the charging rod 110 in a first direction, the first direction being opposite to the direction the rotor 115 may spin when released. Any suitable rotation mechanism or apparatus may be used for rotating the charging rod 110 to wind up the spring 112.

In some embodiments, the charging rod 110 may have a first rod end (the coupling end) 111 coupleable to the rotor 115. The charging rod 110 may be rotated by coupling the rotor 115 to the first end 120 of the body 105 and to the first rod end 111 and using the rotor 115 as a handle to manually rotate the charging rod 110. The first rod end 111 may couple to a corresponding receiving portion of the rotor 115. In some embodiments, the receiving portion may be an opening in a central part of the rotor 115, with an axis passing through about the center of the receiving portion being in general alignment with an axis passing through about the center of the rotor 115. In certain embodiments, the receiving portion may comprise a channel for receiving first rod end 111.

In some embodiments, the first rod end 111 may be shaped and sized to transfer a rotational impulse to the rotor 115 when coupled to the receiving portion of the rotor 115. For example, in some embodiments, the first rod end 111 may have a non-circular cross section for engaging with the corresponding receiving portion of the rotor 115 and imparting a rotational impulse to the rotor 115. In certain embodiments, the first rod end 111 may have a fit with the corresponding receiving portion of the rotor 115 that is not a tight friction fit. The fit may be sufficiently loose that the rotor 115 may fall freely from the charging rod 110 if the rotor 115 is not mated to the first end 120 of the body 105. While being sufficiently loose to not be able to hold the rotor 115 in a coupled position with the charging rod 110, the fit of the first rod end 111 and the receiving portion of the rotor 115 may allow sufficient engagement between the first rod end 111 and the receiving portion of the rotor 115 to allow a transfer of a rotational impulse from the charging rod 110 to the rotor 115.

The charging rod 110 may have any suitable shape and size. For example, in some embodiments, the charging rod 110 may have a circular cross-section, other than at the first rod end 111. In certain embodiments, the charging rod 110 may have a rectangular or square cross-section. In some embodiments, the charging rod 110 may have a cross section with straight edges and curved parts.

In some embodiments, the length of the charging rod 110 may be such that the charging rod 110 extends from a top end of the body 105 to just below the first end 120 of the body. For example, and without limitation, in certain embodiments, the charging rod 110 may be between about 1 and 9/16 inches long to 3 and 1/8 inches long. The cross-sectional width of the charging rod 110 may also be of any suitable size.

The charging rod 110 may be formed of any suitable materials. For example, and without limitation, the charging rod 110 may be formed of plastic, metal, wood or composite materials.

In some embodiments, the charging rod 110 may pass through the body 105 from the activator 130 to the first end 120 of the body 105 without being directly attached to any part of the body 105. For example, one end of the charging rod 110 may be coupled to the activator 130. A portion of the charging rod 110 may be coupled to the spring 112, which in turn may have an end coupled to the body 105. In some embodiments, the end of the spring 112 may be coupled to the activator 130. A part of the charging rod 110 may pass through an opening at the first end 120 of the body 105. The edges or walls of the opening may act as a guide for the charging rod 110 and may keep the charging rod 110 centered or aligned with a spin axis of the rotor 115.

The spring 112 may be positioned within the body 105 to be wound up by the charging rod 110. In some embodiments, one end of the spring 112 may be coupled to the body 105 through an attachment point such that the spring 112 may be tensioned by twisting the spring 112 from a second end of the spring 112. The second end of the spring 112 may be attached to the charging rod 110. In certain embodiments, one end of the spring 112 may be coupled to the activator 130 through an attachment point such that the spring 112 may be tensioned by twisting the spring 112. Any suitable attachment or coupling may be used to couple the spring 112 to any of the body 105, the activator 130 or to the charging rod 110. For example, and without limitation, the coupling for the spring 112 may comprise a friction fit into an opening, a screw, a rivet, a bolt, a weld, an adhesive or a passing of a part of a spring through an opening and bending or thickening the end passed through the opening.

In certain embodiments, the spring 112 may be wrapped around the charging rod 112. Rotating the charging rod 110 may tighten the spring 112 around the charging rod 110.

Any suitable spring 112 for imparting sufficient rotational impulse to the rotor 115 for blowing out birthday candles may be used. The process for selecting suitable springs for storing sufficient energy and releasing it for different tasks is well known.

Referring again to FIG. 1, in some embodiments, the rotor 115 may comprise a first mating portion 151 for mating with a corresponding second mating piece 152, wherein the second mating piece 152 is at the first end 120 of the body 105. The first mating piece 151 may couple with the second mating piece 152 to hold the rotor 115 against the first end 120. Any suitable coupling may be used to couple the first mating piece 151 with the second mating piece 152. In some embodiments, the first mating piece 151 may couple with the second mating piece 152 through a frictional fit, with walls of one of the mating pieces pressing against the walls of the corresponding mating piece. For example, the rotor 115 may have a pair of concentric walls as the first mating piece 151 and the second mating piece 152 may comprise a wall or pieces extending out that fit into the space between the concentric walls of the first mating piece 151. The frictional fit may be tight enough to keep the rotor 115 from falling away from the first end 120 due to gravity but sufficiently loose to allow the rotor 115 to be rotated.

The apparatus may also comprise rotation limiters for limiting rotation of the rotor 115 to a second direction while the rotor 115 is attached to the first end 120. In some embodiments, the rotation limiters may allow for the rotor 115 to be rotated for winding the spring 112 and may prevent the rotor 115 from rotating in the opposite direction, thereby maintaining the spring 112 in a tensioned state once the spring 112 has been wound up. In certain embodiments, a first rotation limiter may be coupled to the rotor 115 for engagement with a corresponding second rotation limiter coupled to the first end 120.

Any suitable rotation limiters may be used. Many such systems are known in the art. For example, in some embodiments, a ratchet and pawl system may be used. Systems with friction clutches may also be used in some embodiments.

In some embodiments, the first mating piece 151 may comprise a rotation limiter 155 for engaging with a corresponding second rotation limiter on the first end 120. In certain embodiments, the rotation limiters may be part of the first mating piece 151 and the second mating piece 152. For example, one or more teeth 160 may be arranged around the spin axis of the rotor 115 and adjacent to a wall forming part of the first mating piece 151. The one or more teeth 160 may engage with corresponding indents, gaps or teeth of the second mating piece 152. For example, the second mating piece 152 may, in some embodiments, comprise several wall portions arranged in a circular pattern with spaces between each wall portion arranged to accept one of the teeth 160 of the first mating piece 151. Rotating the rotor 115 in a second direction may require forcing the teeth 160 to slide along wall portions of the second mating piece 152 until the teeth 160 click into a gap between the wall portions.

The teeth 160 may be shaped to limit rotation to one direction. Any suitable shape may be used for the teeth 160. For example, and without limitation, in some embodiments, the teeth 160 may be wedge shaped.

In some embodiments, the apparatus 100 may comprise a release body coupled to the body 105 and coupleable to the rotor 115 for pushing the rotor 115 away from the rotation limiter and allowing the rotor 115 to freely rotate in the first direction due to the rotational impulse from the charging rod 110.

Any suitable release or release mechanism may be used as the release body. In some embodiments, the charging rod 110 may act as the release body. For example, the charging rod 110 may engage with the rotor 115 and, when activated, may push the rotor 115 away from the second mating piece 152. In certain embodiments, the release body may be a distinct piece from the charging rod 110.

In some embodiments, the apparatus 100 may also comprise an activator 130 for a user to use to activate the release body. The activator 130 may be coupled to the release body and to the body 105 of the apparatus 100. In some embodiments, the activator 130 may be coupled to the charging rod 110. For example, an end of the charging rod 110 may be attached to one side of the activator 130. Pressing down on the activator 130 may push down the charging rod 110 to push the rotor 115 away from the first end 120 of the body 105. The push to the rotor 115 by the charging rod 110 may be sufficiently strong to keep the rotor 115 moving away from the charging rod 110 as the charging rod 110 stops moving. Due to a loose coupling between the rotor 115 and the charging rod 110 in some embodiments, the rotor 115 may decouple from the charging rod 110 to spin freely. In certain embodiments, the charging rod 110 may push the rotor 115 down and then retract while the rotor 115 continues moving forward due to its momentum. In some embodiments, the push from the charging rod 110 may provide sufficient forward momentum to the rotor 115 to initially overcome any lift caused by the airflow from the rotor 115.

Any suitable coupling may be used to attach the release body to the activator 130. For example, and without limitation, an end of the release body may be coupled to one side of the activator 130 using a friction fit into a receiving channel, adhesive, screws, bolts, rivets or may be integrally formed with the activator 130.

Any suitable type of activator may be used as the activator 130. For example, in some embodiments, the activator 130 may be a spring-loaded push button. In certain embodiments, the activator 130 may be a flip switch. The activator 130 may also be a spring-loaded trigger in some embodiments.

The activator 130 may be located at any suitable location on the body 105 of the apparatus 100. In some embodiments, the activator 130 may be located at an end of the body distal to the first end 120.

The activator 130 may be of any suitable size and shape and may be made of any suitable material. For example, in embodiments where the activator 130 may be a spring-loaded button, the diameter of the activator 130 may be between about 0.5" to 2" and the activator 130 may extend between about 0.5" to 1.5" from the body 105. In some embodiments, the activator may be made of, for example and without limitation, plastic, metal, rubber, wood, composite materials, or ceramic.

Referring again to FIG. 1, the apparatus 100 may also comprise a guide 140 coupled to the first end 120 of the body 105 for constraining non-rotational movement of the rotor 115 to a path along the guide 140. The guide 140 may have a restraining end 145 for stopping the rotor 115 from decoupling from the guide 140.

Any suitable type of guide may be used for the guide 140. For example, in some embodiments, the guide 140 may be a rod with a knob as the retraining end 145 at an end distal to the first end 120 of the body 105. The rod may pass through an opening in the rotor 115, with the opening centered around a spin axis of the rotor 115. The rod may be coupled to the first end 120 through attachment to the charging rod 110. For example, the guide 140 may extend from the first rod end 111 of the charging rod 110. In some embodiments, the guide 140 and the charging rod 110 may share a common central axis or spin axis with the rotor 115.

In embodiments where the guide 140 is attached to the charging rod 110, any suitable coupling may be used to attach the guide 140 to the charging rod 110. For example, and without limitation, the guide 140 may be glued to, friction fitted with, formed integrally with, welded to, or screwed onto the charging rod 110.

In certain embodiments, the guide 140 may be a flexible guide, such as, for example, a string, cable or line. Pointing the apparatus 100 in a downwards direction may cause the flexible guide 140 to extend down. In some embodiments, the airflow from the spinning rotor 115 may cause a sufficiently light and flexible guide 140 to extend out in alignment with the direction of airflow. In certain embodiments, the momentum of the rotor 115 as it is pushed away from the body 105 by the release body may cause a flexible and lightweight guide to extend out as the rotor 115 moves away from the body 105.

The guide 140 may be formed of any suitable materials. For example, and without limitation, the guide 140 may be formed of plastic, metal, or natural polymer such as fabric or coated fabric. In some embodiments, low friction materials may be used for the guide 140.

The guide 140 may be of any suitable dimensions. For example, the length of the guide 140 may be between about 0.5" to 2.5". The cross-sectional width of the guide 140 may be sufficiently small to minimize friction with the walls of the hole in the rotor 115 that the guide 140 passes through but sufficiently large to maintain enough strength to guide the lateral movement of the rotor 115. As with the dimensions of the various parts of the apparatus 100, the cross-sectional width of the guide 140 may be dependent on the material properties of the material forming the guide 140. For example, and without limitation, in certain embodiments where the guide 140 is formed of a plastic material, the cross-sectional width of the guide 140 may be about 1/16" to 1/8" of an inch.

In certain embodiments, cross-sectional width of the guide 140 may vary along the length of the guide 140. In some embodiments, the cross-sectional width of the guide 140 may taper down from the first end 120 of the body until it meets the restraining end 145. In other embodiments, the cross-sectional width may taper down from the restraining end 145.

The restraining end 145 may, in some embodiments, be a widening of the guide 140 to keep the rotor 115 from falling or flying off of the guide 140. Any suitable type of restraint may be used as the restraining end 145. For example, in some embodiments, the restraining end 145 may be a piece attached to the end of the guide 140, with the piece sized to not pass through the central hole in the rotor 115 that the guide 140 passes through. The restraining 145 end may be, for example and without limitation, a ball, a disc, a knot, or a block.

The restraining end 145 may be coupled to the guide 140 using any suitable coupling. For example, in some embodiments, the restraining end may be, without limitation, screwed on to, glued to, welded to, friction fitted to or formed integrally with the guide 140.

Referring to FIG. 1 and to FIG. 2*a*, and FIG. 2*b*, in some embodiments, the rotor 115 may comprise at least two blades 117 for spinning and generating air flow for blowing out the candles. In certain embodiments, the rotor 115 may comprise three blades 117. In other embodiments, the rotor 115 may comprise four blades 117.

In some embodiments, the rotor 115 may include a central hub 116 comprising the first mating portion 151 and an opening centred around a spin axis of the rotor 115 for receiving the charging rod 110. The blades 117 may be positioned equidistant around the central hub 116.

The central hub 116 may be of any suitable size. For example, in some embodiments, the central hub 116 may have a diameter of between about 0.5" to about 1.5". In certain embodiments, the central hub 116 may have a diameter of about 1". The height of the central hub 116 in some embodiments may be between about, without limitation, 0.25" to 0.75". In certain embodiments, the height of the central hub 116 may be about 0.5".

In some embodiments, the rotor 115 may also comprise an outer safety ring 170 positioned along an outer circumference of the rotor 115 and coupled to a distal edge of each blade 117 for providing rigidity to the rotor 115 and for partially shielding the blades 117 from external objects. The outer safety ring 170 may also act, in some embodiments, as a safety barrier for assisting a user in avoiding placing their fingers in the path of the blades 117. Additionally, the outer safety ring 170 may provide, in certain embodiments, a surface for holding and handling the rotor 115 with. For example, when winding up the charging rod 110, a user may hold the rotor 115 by the outer safety ring 170 while rotating it.

The outer safety ring 170 may have any suitable diameter. The diameter may be based on design considerations about compactness of the apparatus 100 as well as the amount of airflow desired by a user. Having a relatively large surface area for each blade 117 and shaping the blades to increase the amount of airflow generated by the rotor 115 may allow for a compact sized rotor 115 that may be easily handled by a child. For example, and without limitation, in some embodiments, the diameter of the outer safety ring 170, and thereby the diameter of the rotor 115, may be between about 2.5" to about 4.5". In certain embodiments, the diameter of the outer safety ring 170 may be about 4".

The outer safety ring 170 may have any suitable height. For example, and without limitation, in some embodiments, the outer safety ring 170 may have a height of about ⅛" to ½". In certain embodiments, the outer safety ring 170 may have a height of about ¼".

The outer safety ring 170 may have any suitable thickness. In some embodiments, the outer safety ring 170 may have a thickness similar to the thickness of other parts of the apparatus 100. For example, and without limitation, the outer safety ring 170 may have a thickness of about 1/16".

In some embodiments, each blade 117 of the rotor 115 may comprise a blade scoop 180 extending from a central hub 116 of the rotor 115 to an outer safety ring 170 positioned around an outer circumference of the rotor 115. The blade scoop 180 may have a convex shaped leading edge 181 for gathering air for the blade scoop 180 to push along the blade 117. The blade 117 may also comprise, in some embodiments, a blade overhang 185 for pushing air from the blade scoop 180 out from the rotor 115. The blade overhang 185 may have a trailing edge 186 positioned below a bottom of the central hub 116. A portion of the blade 115 forming the trailing edge 186 may have a tangent that is angled, in some embodiments, at between about 30 degrees to 60 degrees below a plane that the outer circumference lies in. In certain embodiments, the tangent may be angled at least about 45 degrees below the plane that the outer circumference lies in.

The blade scoop 180 and the blade overhang 185 may be sized and positioned to generate a directed airstream for blowing out the birthday candles on a cake. The convex shape of the leading edge 181 may scoop or push more air along the blade 117 than a flat leading edge might as the blade 117 swings forward.

The phrase 'convex shaped leading edge 181' refers to the curved line formed by the leading edge 181. The leading edge 181 extends from the central hub 116, to which the leading edge 181 may be coupled, to the outer safety ring 170. In some embodiments, the line may be a convex curve with the line being at a relatively higher position at the central hub 116 than at the outer safety ring 170. In certain embodiments, a portion of line representing the leading edge 181 may extend to a position higher than positions at either end of the line, with the leading edge 181 curving up from the central hub 116 and then curving down to the outer safety ring 170.

Any suitable amount of curvature of the leading edge 181 relative to the plane of the outer safety ring 170 may be used. In some embodiments, the curvature may be such that the highest portion of the leading edge 181 may extend between about, without limitation, 1/16" to ⅛" above the higher of the intersection of the leading edge 181 with the central hub 116 and the intersection of the leading edge 181 with the outer safety ring 170. In certain embodiments, the curvature may be such that the highest portion of the leading edge 181 may extend between about, without limitation, ⅛" to about ½" above the higher of the intersection of the leading edge 181 with the central hub 116 and the intersection of the leading edge 181 with the outer safety ring 170.

As the blade 117 moves, air below the leading edge 181 of the blade scoop 180 may be gathered or pushed along the blade 117. The blade 117 may be curved down from the blade scoop, ending in the trailing edge 186 of the blade overhang 185. Due to the overhang and the angle of the blade overhang 185 relative to the plane of the rotor 115, additional air may be impacted by the blade 117, as compared to a blade not having an overhang, and directed away from the rotor 115.

The angle of the blade overhang 185 as well as the increased surface area, as compared to a blade without an overhang, is advantageous over blades not having a sharply angled overhang due to the increased air flow generated. A large drag factor due to an angled blade overhang 185 may not be detrimental but may be advantageous in some embodiments because extended rotation of the rotor 115 beyond the candles being blown out is not needed. The time span during which the rotor spins may be a few seconds. A blade designed to have high drag or air resistance due to a sharply angled large surface area may generate a sufficient burst of air in just a few seconds to blow out birthday candles. Additionally, a blade 117 having a large overhang with the blade overhang 185 along with the blade scoop 180 may be advantageous in some embodiments by allowing for a more compact design of the rotor 115 in terms of the rotor diameter. As much air flow may be generated with a smaller rotor diameter in some embodiments using the blade overhang 185 and the blade scoop 180 than rotors with more streamlined blades that have a larger rotor diameter.

The blade overhang may extend any suitable distance below the outer safety ring 170. For example, and without limitation, in some embodiments, the blade overhang 185 may extend between about ¼" to about ¾" below a bottom of the outer safety ring 170. In certain embodiments, the blade overhang 185 may extend about ⅜" below the bottom of the outer safety ring 170.

In some embodiments, a height of the blade 117 may be equal to at least one quarter, or in certain embodiments, three quarters, of a length of the blade 115. The height may be the vertical distance between a highest and lowest point of the blade 115. The height of the blade 117 may also be defined as the shortest distance between a bottom plane, the bottom plane parallel to the plane of the outer circumference and touching a part of the trailing edge 186 furthest below the central hub 116, and a point of the blade 115 furthest from the bottom plane along an axis perpendicular to the bottom plane. The length of the blade 115 may be defined as the chord length between an intersection of the outer safety ring 170 and a projection of the leading edge 181 onto a plane of the outer safety ring 170 and an intersection between the outer safety ring 170 and a projection of the trailing edge 186 onto the plane of the outer safety ring 170.

Increasing the height to length ratio of the blades 117 may, in some embodiments, allow for a smaller rotor diameter while generating similar air flow as rotors 115 with blades 117 with a smaller height to length ratio.

The blade 117 may have any suitable shape as viewed from above in a top view. For example, and without limitation, the leading edge 181 may be curved. The trailing edge 186 may also be curved or straight and may have any suitable length. For example, and without limitation, in some embodiments, the length of the trailing edge 186 may be between about ⅓" to 1.5".

The blade 117 may have any suitable thickness. For example, and without limitation, in some embodiments, the blade 117 may have a thickness of about 1/16".

The various components of the rotor 115 may be formed of any suitable materials. For example, the rotor 115 may be formed of, without limitation, plastic, wood, cardboard or paper products, composites such as fiberglass, and metals. In some embodiments, a flexible plastic material may be used to form the blades 117. Using a flexible and lightweight plastic material may be advantageous in that the weight of the rotor may be kept low. Additionally, the use of a flexible material may be advantageous in providing an additional safety measure. Touching a spinning rotor 115 or blades 117 made of a flexible material may be safer than touching spinning blades 117 made of a more rigid material.

The blades 117 may be coupled to the central hub 116 and to the outer safety ring 170 using any suitable coupling. For example, and without limitation, the coupling may use adhesives, welds, bolts, inserts friction fitted into holes, and in some embodiments, the blades 117 may be integrally formed with one of or both the central hub 116 and outer safety ring 170.

In some embodiments, the components comprising the rotor 115 may be formed of different materials. For example, in certain embodiments, the blades 117 may be formed of a more flexible plastic than the outer safety ring 170, which may be formed a more rigid plastic.

Referring again to FIG. 1 and FIG. 2*a*, there is provided, in some embodiments, a rotor 115 for blowing out birthday candles. The rotor 115 may comprise at least two blades 117. In some embodiments, the rotor 115 may comprise three blades 117. In certain embodiments, the rotor 115 may comprise four blades 117. In some embodiments, the rotor 115 may be attachable to a wind-up launcher for imparting a rotational impulse to the rotor 115. Each blade 117 of the rotor 115 may be as already described in the present disclosure.

In use, a user may couple the rotor 115 to the first end 120 and to the charging rod 110 by pushing the rotor 115 towards the first end. The user may then begin turning the rotor 115 in a second direction (opposite to the direction of free spin for the rotor 115) to wind up the spring 112 by turning the charging rod 110. The user may feel a clicking and hear a clicking sound while turning the rotor 115 as rotation limiters of the rotor 115 snap into gaps in the second mating piece of the first end 120 during the rotation. Once the spring 112 is wound up, the user may no longer be able to easily rotate the rotor 115. The user may then point the bottom of the rotor 115 at birthday candles on a cake and when ready, may press the activator 130 to push the charging rod 110 forward. The charging rod 110 may push the rotor 115 free of the first end 120, causing the spring 112 to suddenly unwind, spinning the charging rod 110 and imparting a rotational impulse to the rotor 115.

In addition to the rotational impulse, the charging rod 110 may impart a forward momentum to the rotor 115, causing the rotor 115 to decouple from the charging rod 110 while reaching its top rotational speed prior to decoupling. After decoupling, the rotor 115 may spin freely for a few seconds, maintaining a strong airflow directed at the candles, while moving along the guide 140. The burst of air from the rotor 115 may blow out all of the candles. As the rotor 115 slows down, the restraining end 145 of the guide 140 may keep the rotor 115 from falling away from the guide 140.

Figure 3:
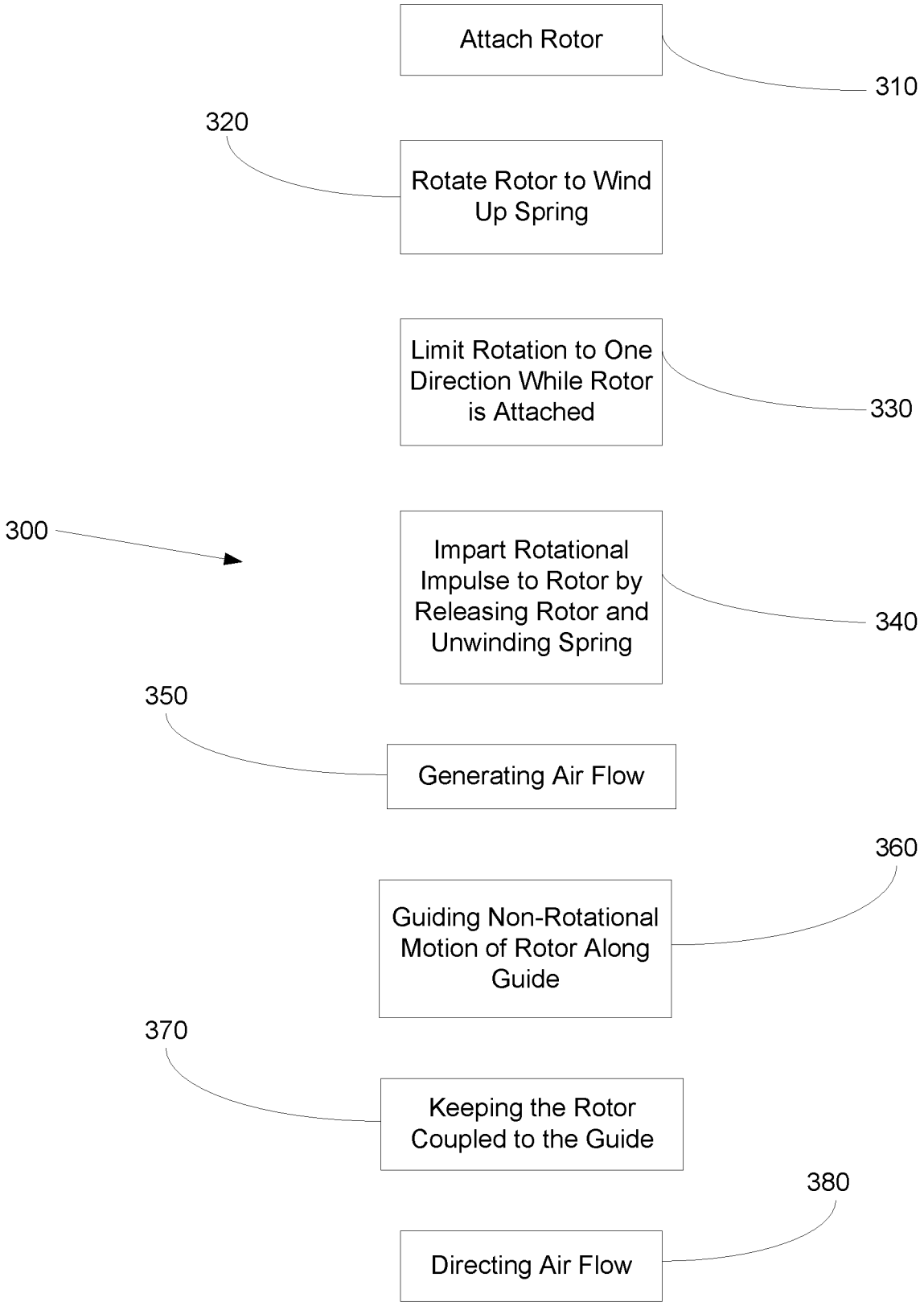
FIG. 3 shows a method for blowing out birthday candles, according to one embodiment.

Referring to FIG. 3, an embodiment of a method 300 for blowing out candles is provided. At box 310, a rotor for blowing air may be attached to a housing of a launching apparatus by pushing the rotor onto a mating piece of the housing such that the rotor is coupled to both the housing and a charging rod.

At box 320, the rotor may be rotated in a second direction to rotate the charging rod and wind up a spring coupled to the charging rod.

At box 330, rotation of the rotor may be limited to the second direction to keep the spring wound up by engaging rotation limiters between the rotor and the housing.

At box 340, a rotational impulse to the rotor from the spring through the charging rod may be generated by pushing the rotor away from the rotation limiters and releasing the rotor from the charging rod to allow the rotor to spin freely. Pushing the rotor away from the rotation limiters may allow the spring to quickly unwind, thereby imparting a rotational impulse to the rotor.

At box 350, air flow may be generated by pushing air along each of two or more blades of the rotor. The air flow may be generated, in some embodiments, by capturing air under a convex shaped leading edge of the blade as the rotor spins. At box 360, airflow may be directed to blow out the birthday candles by directing airflow away from a plane the rotor spins in by pushing air flowing along the blade using a trailing edge that is formed by an overhanging portion of the blade that is angled at least 30 degrees below the plane the rotor spins in. In some embodiments, the overhanging portion may increase the airflow.

At box 370, the non-rotational movement of the rotor may be guided by having the rotor spin freely along a guide extending from the charging rod.

At box 380, the rotor may be kept from falling away from the guide by having the rotor bump into a constraint at an end of the guide.

The terminology used herein is for the purpose of describing particular embodiments only and is not intended to be limiting. Accordingly, as used herein, the singular forms "a", "an" and "the" are intended to include the plural forms as well, unless the context clearly indicates otherwise. It will be further understood that the terms "comprises" and "comprising," when used in this specification, specify the presence of one or more stated features, integers, steps, operations, elements, and components, but do not preclude the presence or addition of one or more other features, integers, steps, operations, elements, components, and groups.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. An apparatus for blowing out candles, the apparatus comprising:

(a) a body for holding the apparatus and housing parts of the apparatus;

(b) a rotor with at least two blades for spinning and generating air flow for blowing out the candles, the rotor having a first mating portion for mating with a corresponding second mating piece at a first end of the body for holding the rotor against the first end;

(c) a charging rod coupled to the body for transferring a rotational impulse to the rotor for rotating the rotor in a first direction, the charging rod having a first rod end coupleable to the rotor;

(d) a rotation limiter coupled to at least one of the first mating piece and the second mating piece for limiting rotation of the rotor to a second direction while the rotor is attached to the first end;

(e) a release body coupled to the body and coupleable to the rotor for pushing the rotor away from the rotation limiter and allowing the rotor to freely rotate in the first direction due to the rotational impulse from the charging axle;

(f) an activator for activating the release body, the activator coupled to the release;

(g) a guide coupled to the first end of the body for constraining non-rotational movement of the rotor to a path along the guide wherein the guide has a restraining end for stopping the rotor from decoupling from the guide;

wherein transfer of the rotational impulse from the charging axle to the rotor upon activation of the release body causes the rotor to decouple from the charging rod and to spin freely along the guide, thereby generating airflow for blowing out the candles.

2. The apparatus of claim 1 further comprising a spring coupled to the charging rod for storing energy when charged by the charging rod and releasing the stored energy to the rotor through the charging rod upon activation of the release.

3. The apparatus of claim 1 wherein the charging rod comprises the release.

4. The apparatus of claim 1 wherein the guide is coupled to the charging rod.

5. The apparatus of claim 1 wherein the guide extends out along a spin axis of the rotor upon the charging rod transferring a rotational impulse to the rotor.

6. The apparatus of claim 1 wherein the rotor further comprises:

(a) a central hub comprising the first mating portion and an opening centred around a spin axis of the rotor for receiving the charging rod;

(b) an outer safety ring positioned along an outer circumference of the rotor and coupled to a distal edge of each blade for providing rigidity to the rotor and for partially shielding the blades from external objects.

7. The apparatus of claim 1 wherein each blade of the rotor comprises:

(a) a blade scoop extending from a central hub of the rotor to an outer safety ring positioned around an outer circumference of the rotor, the blade scoop having a convex shaped leading edge for gathering air for the blade scoop to push along the blade;

(b) a blade overhang for pushing air from the blade scoop out from the rotor, the blade overhang having a trailing edge positioned below the central hub, with a portion of the blade forming the trailing edge having a tangent that is angled at least about 30 degrees below a plane that the outer circumference lies in;

wherein the blade scoop and blade overhang are sized and positioned to create a directed airstream for blowing out the birthday candles.

8. The apparatus of claim 7 wherein the tangent is angled at least about 45 degrees below the plane that the outer circumference lies in.

9. The apparatus of claim 7 wherein the tangent is angled at least about 60 degrees below the plane that the outer circumference lies in.

10. The apparatus of claim 7 wherein the convex shape of the leading edge is formed by the leading edge curving up away from a bottom of the central hub and then down to the outer safety ring.

11. The apparatus of claim 7 wherein a height of the blade is equal to at least ¼ of a length of the blade, wherein the height is the shortest distance between a bottom plane, the bottom plane parallel to the plane of the outer circumference and touching a part of the trailing edge furthest below the central hub, and a point of the blade furthest from the bottom plane along an axis perpendicular to the bottom plane, and the length of the blade is the chord length between an intersection of the outer safety ring and a projection of the leading edge onto a plane of the outer safety ring and an intersection between the outer safety ring and a projection of the trailing edge onto the plane of the outer safety ring.

12. The apparatus of claim 11 wherein the height of the blade is equal to at least ⅔ of the length of the blade.

* * * * *